US005535456A

United States Patent [19]

Chai

[11] Patent Number: 5,535,456

[45] Date of Patent: Jul. 16, 1996

[54] POTTY

[76] Inventor: In-ki Chai, 231-204 Chugong Apt., 140 Gaepo-dong, Kangnam-ku, Seoul 135-240, Rep. of Korea

[21] Appl. No.: 374,302

[22] Filed: Jan. 18, 1995

[30] Foreign Application Priority Data

Jan. 24, 1994 [KR] Rep. of Korea ..... 94-1236

[51] Int. Cl.[6] ..... A47K 11/02

[52] U.S. Cl. ..... 4/449; 4/902; 4/DIG. 5

[58] Field of Search ..... 4/449, 902, DIG. 5

[56] References Cited

U.S. PATENT DOCUMENTS

| | | | |
|---|---|---|---|
| 2,075,308 | 3/1937 | Simonsen | 4/902 X |
| 2,896,567 | 7/1959 | Gilmour | 4/902 X |
| 4,162,490 | 7/1979 | Fu et al. | 4/902 X |
| 4,883,749 | 11/1989 | Roberts et al. | 4/902 X |
| 5,008,964 | 4/1991 | Dean et al. | 4/449 X |

FOREIGN PATENT DOCUMENTS 90-4397 of 0000 Rep. of Korea .

*Primary Examiner*—Charles E. Phillips
*Attorney, Agent, or Firm*—Watson Cole Stevens Davis

[57] ABSTRACT

A potty suitable for letting infants naturally and at an early age accustom themselves to relieve themselves in a given place and in a correct body position. The potty has a first switch operated by pressure caused by the weight of an infant seated on the seat, a second switch normally turned off but turned on when it comes into contact with urine. A first sound generator is electrically connected to the first and second switches and generates a sweet sound when the first and second switches are turned on at the same time. The potty may be also provided with a detachable urine receptacle. A plurality of detachable wheels, a plurality of retractable wheels or a plurality of detachable legs may be mounted to the lower section of the potty so that the potty can be used as a riding toy.

5 Claims, 3 Drawing Sheets

POTTY

BACKGROUND OF THE INVENTION

1. Field of the Invention

The present invention relates in general to potties for infants just grown up enough to go to stools by themselves and, more particularly, to a structural improvement in such potties for generating a sweet sound, such as sweet melody or sweet voice message stimulating interest of the infants, when an infant relieves oneself in a correct body position such that the urine reaches a predetermined position of the potty, thereby letting the infants to naturally accustom themselves early to relieve themselves in a given place and in the correct body position thereby and promoting emotion and character building of the infants.

2. Description of the Prior Art

Babyhood is a very important stage of a the life of human being since the babyhood is the stage for basic formation of emotion, custom and character. In this regard, it is required to provide infants during babyhood with appropriate conditions suitable for giving the infants correct emotion and correct custom. It is preferred to let the infants naturally acquaint themselves with interest with the correct emotion as well as with the correct custom.

Thus, it is very important to let the infants naturally early acquaint themselves with interest to relieve themselves in a given place and in the correct body position. This will promote formation of emotion and character of the infants during babyhood.

As well known to those skilled in the art, there have been proposed several types of potties for infants just grown up enough to go to stools by themselves. However, most of the typical potties merely provide an intrinsic function of a potty. Of course, there have been proposed potties which are particularly designed, taking into consideration the emotion building of the infants. However, such potties are merely designed in an animal configuration or merely stimulate visual interest of the infants by providing decorative patterns for the potty bodies. Therefore, the typical potties do not let the infants naturally early accustom themselves with interest to relieve themselves in a given place and in the correct body position. The typical potties thus have a problem that the parents must forcibly seat the infants on the potties whenever the infants want to relieve themselves until the infants grow up enough to go to stools by themselves. However, such relieving custom of the infants is not naturally formed by infants with interest but forcibly formed so that the infants require much time for accustoming themselves to relieve themselves in a given place and in the correct body position. Furthermore, this will run counter to promote correct emotion building of the infants.

Korean U.M. Publication No. 90-4397 discloses a potty provided with a melody generator. This potty has an animal head and a push button provided in the animal head. The potty also includes the melody generator which is operated by pushing on the push button.

However, the melody generator of the above Korean potty generates the melody by the pushing motion of the push button regardless of relieving motion of the infants. Therefore, the above potty with the melody generator has a problem that the potty scarcely lets the infants naturally early accustom themselves to relieve themselves in a given place and in the correct body position.

SUMMARY OF THE INVENTION

It is, therefore, an object of the present invention to provide a potty in which the above problems can be overcome and which has a typical potty function and generates a sweet sound, such as sweet melody or sweet voice message stimulating interest of infants, when an infant relieves oneself in a correct body position such that the urine reaches a predetermined position of the potty, thereby letting the infants naturally early accustom themselves to relieve themselves in a given place and in the correct body position and promoting emotion and character building of the infants, which potty may be also provided with wheels or interesting animal legs so that the potty may be selectively used as a typical potty or as a riding toy.

In carrying out the above objective, a potty in accordance with the invention comprises a seat, a bowl and a skirt supporting the seat and the bowl, and further comprises: a first switch provided in a predetermined portion of the seat and operated by pressure caused by the weight of an infant seating on the seat; a second switch provided in a predetermined portion of the bottom of the bowl, the second switch being normally turned off but turned on when this switch comes into contact with urine; and a first sound generator provided in a predetermined portion of the potty and electrically connected to the first and second switches and generating a sound when the first and second switches are turned on at the same time.

The potty of the invention may be also provided with a urine receptacle detachably mounted to a predetermined portion of the potty, the urine receptacle having a third switch and a second sound generator, the second sound generator being electrically connected to the third switch and generating a sound when the third switch is turned on. The potty of the invention may also be provided with a plurality of detachable wheels, a plurality of hidable wheels or a plurality of detachable legs.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
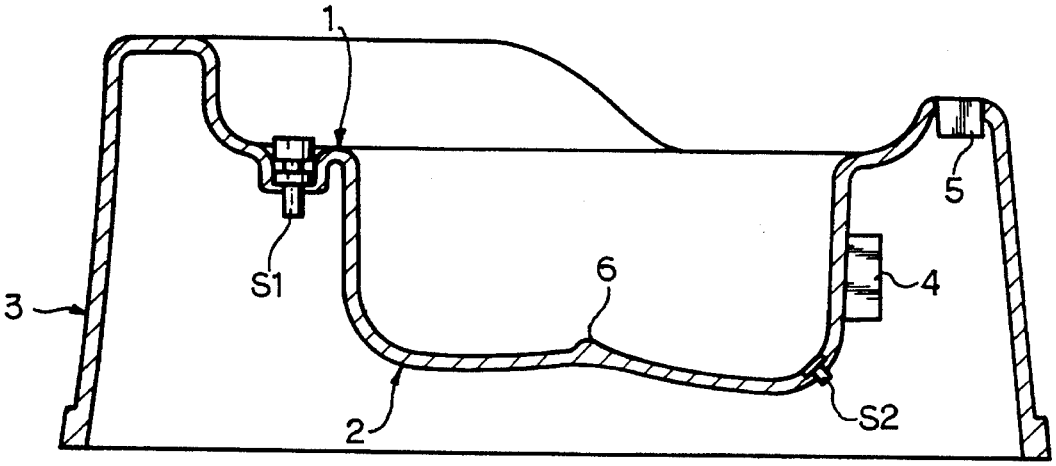
FIG. 1 is a sectional view of a potty in accordance with an embodiment of the present invention.

With reference to FIG. 1, there is shown a potty in accordance with a first embodiment of the present invention. The potty of the first embodiment is a potty commonly used by infants regardless of sex of the infants. This potty generates a sweet sound, such as sweet melody or sweet voice message stimulating interest of an infant, when an infant is seated on the potty in a correct body position and relieves oneself such that the urine reaches a predetermined position of the potty.

The above potty exclusively generates the sweet sound when the infant is seated on the potty in order for relieving oneself. However, the potty does not generate the sound in the other case such as washing of the potty. In order to let the potty achieve its intrinsic function, that is, the function of the typical potty, as well as generate the sweet sound when the infant seating on the potty relieves oneself in the correct pose of body, the potty of the first embodiment has a seat 1 and a bowl 2, which bowl 2 is placed in the center of the seat 1. The potty also includes a skirt 3 for supporting the seat 1 with the bowl 2 at an appropriate height. The above construction of the potty will be equal to that of a typical potty.

In accordance with the first embodiment of the invention, the potty further includes a first switch $S_1$ or a pressure switch which is placed on an appropriate position of the seat 1 and operated by the pressure caused by the weight of the infant seating on the seat 1. The front end section of the bottom of the bowl 2 is provided with a second switch $S_2$, which switch $S_2$ is normally turned off but turned on when the switch $S_2$ comes into contact with urine. The potty also includes a first sound generator 4 mounted on the exterior surface of the front wall of the bowl 2. The sound generator 4 is electrically connected to the first and second switches $S_1$ and $S_2$. In order to amplify the sound generated by the sound generator 4, the potty also has a first amplifier 5, which amplifier 5 is placed, for example, on the front top of the potty as shown in FIG. 1.

The sound generator 4 is electrically connected to the first and second switches $S_1$ and $S_2$ such that the sound generator 4 exclusively generates the sweet sound, such as the sweet melody or the sweet voice message, when the first and second switches $S_1$ and $S_2$ are turned on at the same time. In the present invention, it is preferred to use typical batteries or DC power source as a power source of the sound generator 4.

The first switch $S_1$ is constructed such that it is normally turned off but exclusively turned on by the pressure caused by the weight of the infant seated on the seat 1. In order to let the first switch $S_1$ be operated when it is pressed down by the weight of the infant seated on the seat 1, the first switch $S_1$ may be a typical push switch as shown in FIG. 1. However, it should be understood that the first switch $S_1$ may be in the form of another type switch capable of achieving the above pressure sensitive switching motion.

The second switch $S_2$ is provided, for example, in the front end section of the bottom of the bowl 2 such that the switch $S_2$ naturally comes into contact with urine when the infant relieves oneself on the potty in a correct body position. The second switch $S_2$ is normally turned off but turned on when the switch $S_2$ comes into contact with the urine. To assure that the urine will come into contact with the second switch $S_2$ when the infant relieves oneself on the potty in the correct body position, the bottom of the front section at the bowl 2 is gradually inclined such that the front end with the second switch $S_2$ of the bottom is lower than the center of the bottom. In the potty of the first embodiment of the present invention, the second switch $S_2$ is preferably placed at or about the lowermost bottom of the front section of the bowl 2 as shown in FIG. 1. Meanwhile, the rear section of the bowl 2, that is, the section between the rear end to the center of the bottom of the bowl 2, which rear section is for mainly receiving feces thereon, is horizontally constructed. In order to prevent the feces on the rear section of the bowl 2 from being mixed with the urine on the front section of the bowl 2, a predetermined height of partition wall 6 is provided on the junction between the front section and the rear section of the bottom of the bowl 2. With the partition wall 6, it is possible to prevent malfunction of the second switch $S_2$ as well as to facilitate treatment of the feces on the rear section of the bowl 2.

Figure 2:
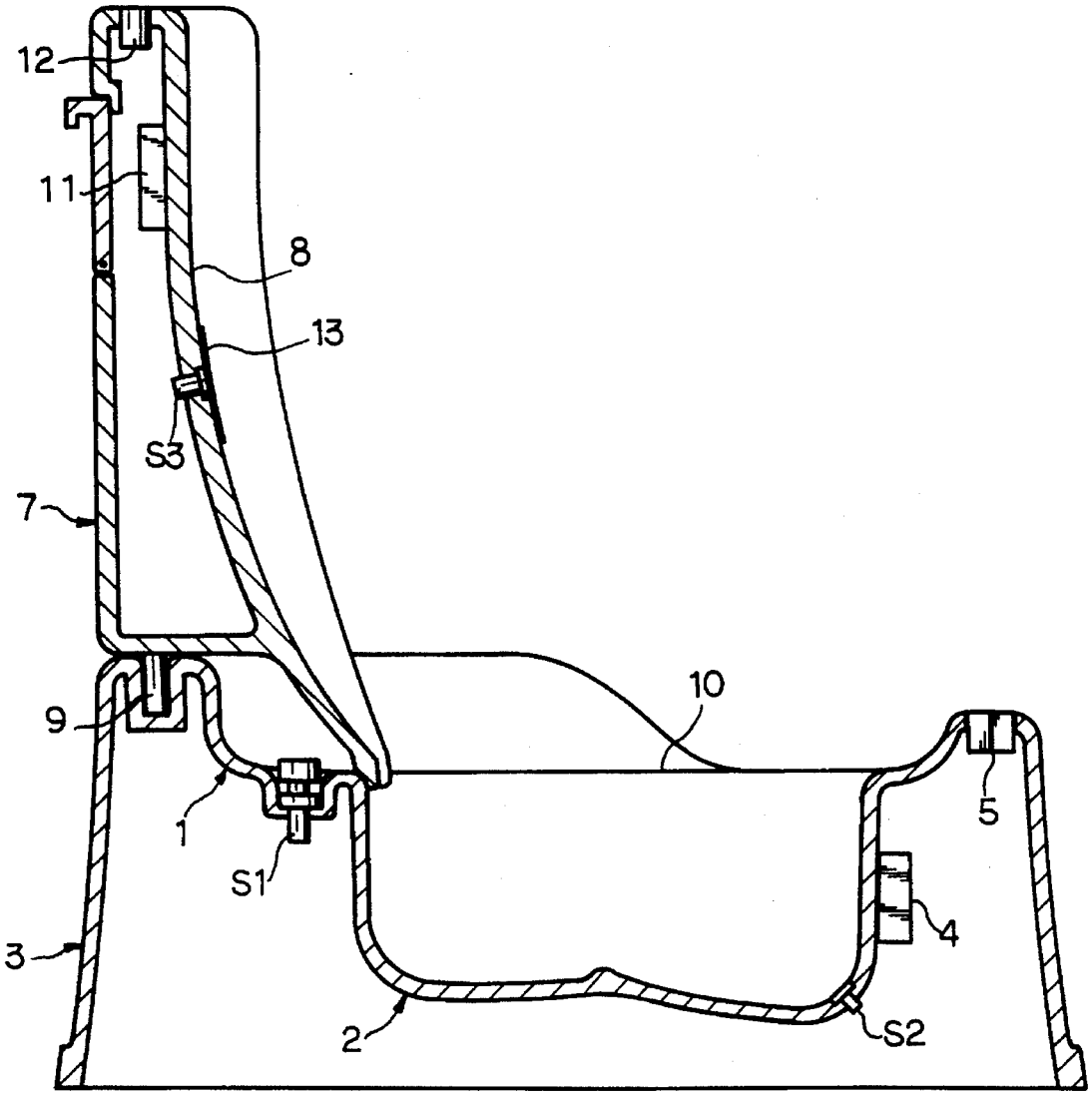
FIG. 2 is a sectional view of a potty in accordance with another embodiment of the present invention.

Turning to FIG. 2, there is shown a potty in accordance with a second embodiment of the present invention. The potty of the second embodiment is particularly for male infants relieving themselves while standing in front of the potty. The potty of the second embodiment generates a sweet sound, such as sweet melody or sweet voice message stimulating interest of the male infant, when the infant stands in front of the potty in a correct body position and relieves oneself such that the urine reaches a predetermined position of the potty. Therefore, this potty lets the male infants naturally early accustom themselves to relieve themselves in a given place and in a correct body position.

In order to achieve the above object of the second embodiment, the potty of the second embodiment includes the potty body which has the same construction as that of the potty of the first embodiment and further includes a urine receptacle 7, which receptacle 7 is detachably mounted to an appropriate portion of the potty body, for example, a rear section of the seat 1 of the potty body as shown in FIG. 2.

The urine receptacle 7 comprises a front wall 8 for receiving and guiding, without splashing of the urine, the urine relieved by the male infant relieving oneself while standing in front of the potty. The urine receptacle 7 also includes a coupling member 9 for coupling the receptacle 7 to the seat 1 of the potty. In the potty of the second embodiment, the lower end of the front wall 8 for receiving and guiding the urine extends to the rear side of a center opening 10 of the bowl 2. A third switch $S_3$ is provided in an appropriate position of the front wall 8 of the urine receptacle 7, for example, about the center of the front wall 8 as shown in FIG. 2. In the same manner as described for the second switch $S_2$, the third switch $S_3$ is normally turned off but turned on when the switch $S_3$ comes into contact with the urine. The potty also includes a second sound generator 11 mounted on the exterior surface of the front wall 8 of the urine receptacle 7. The sound generator 11 is electrically connected to the third switch $S_3$. In order to amplify the sound generated by the sound generator 11, the potty also has a second amplifier 12, which amplifier 12 is placed, for example, on the top of the urine receptacle 7 as shown in FIG. 2. In the potty of the second embodiment, it is preferred to form a target 13 on the front wall 8 of the urine receptacle 7 about the third switch $S_3$ so that the infant standing in front of the potty relieves oneself in order to direct the urine to the target 13. With the target 13, the potty of the second embodiment naturally lets the infant accustom to relieve oneself in a correct body position. In the present invention, the target 13 may be designed as a typical shooting target or in an interesting pattern stimulating interest of the infants. The target 13 is also preferably colored in distinct colors.

In the potty of the second embodiment, the third switch $S_3$, the second sound generator 11 and the second amplifier 12 are operated by a second power source different from the power source for the first and second switches $S_1$ and $S_2$, the first sound generator 4 and the first amplifier 5. When using the potty of the second embodiment with the urine receptacle 7 coupled to the seat 1, the first and second switches $S_1$ and $S_2$ which are cooperate with each other can not be operated, while only the third switch $S_3$ can be operated.

With the above construction, the potty according to each of the first and second embodiments of the present invention provides a function of a typical potty as well as generates a sweet sound, such as sweet melody or sweet voice message stimulating interest of an infant, due to operation of the sound generator 4 or 11 in accordance with operation of the first and second switches $S_1$ and $S_2$ or the third switch $S_3$ when the infant relieves oneself in a correct pose of body such that the urine reaches a predetermined position. Therefore, the potty lets an infant take an interest in relieving oneself in the correct body position and thus lets the infant naturally early accustom oneself to relieve oneself in a given place and in the correct body position.

Figure 3:
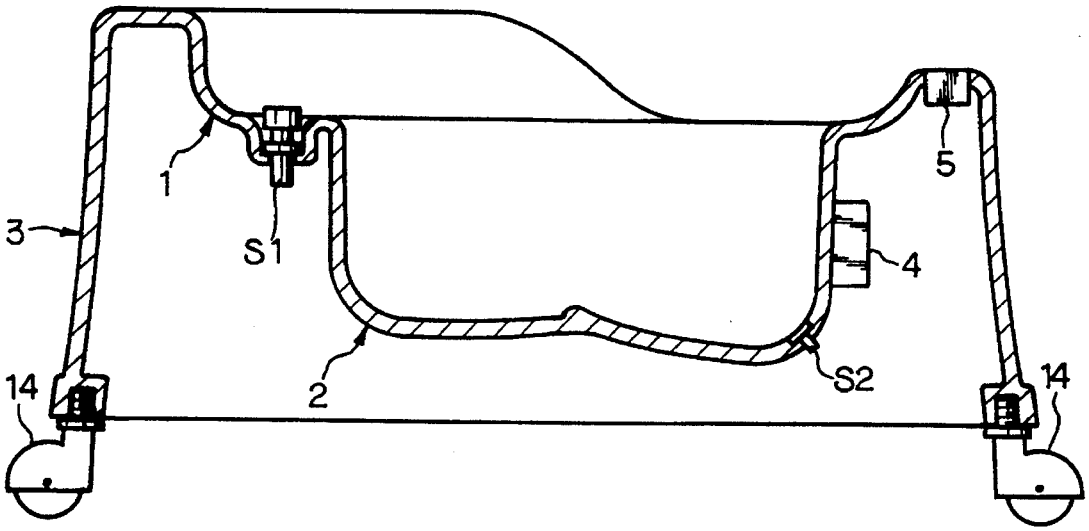
FIGS. 3 to 5 are sectional views of potties in accordance with other embodiments of the present invention respectively.
Figure 4:
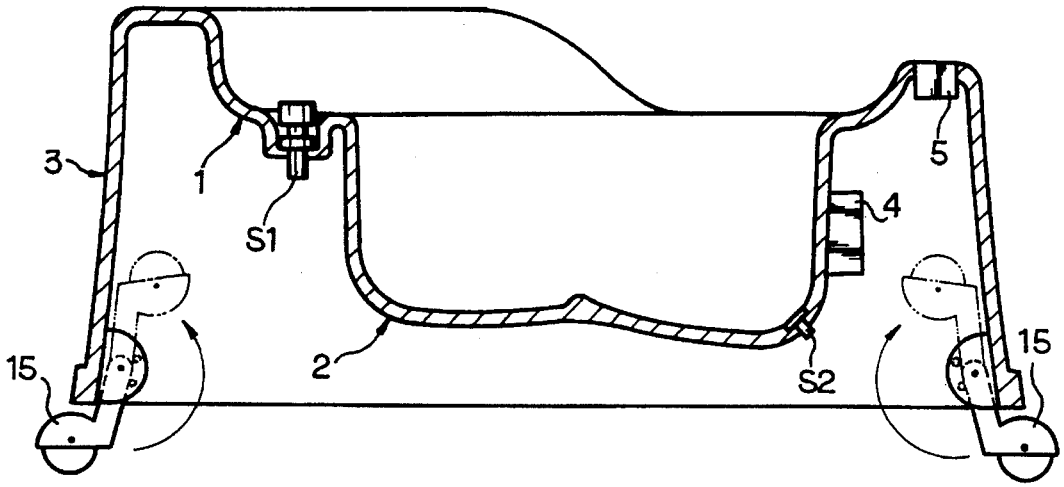
Figure 5:
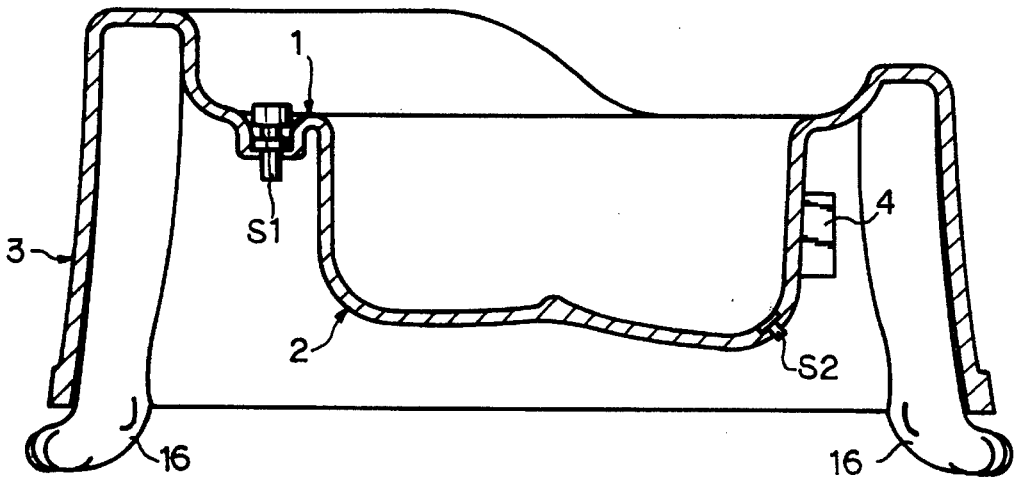

Referring next to FIGS. 3 to 5, there are shown potties in accordance with other embodiments of the present invention. These potties are provided with wheels or animal legs so that the potties can be selectively used as riding toys when the potties are not used as typical potties.

As described in more detail, the potty according to a third embodiment is provided with detachable wheels 14 on the lower end of the skirt 3 of the potty body as shown in FIG. 3, which potty body has the same construction as that of the first embodiment of FIG. 1. The wheels 14 of the potty of the third embodiment may be separated from the potty body so that this potty can be used as a typical potty while placed on a given position. However, the wheels 14 may be coupled to their associated portions of the lower end of the skirt 3 so that the potty with the wheels 14 can be used as a riding toy.

The potty according to a fourth embodiment is provided with retractable wheels 15 similar to those of the third embodiment. However, the wheels 15 of the fourth embodiment are different from the wheels 14 of the third embodiment in that the arms of the wheels 15 are pivoted to the lower end of the skirt 3 so that the wheels 15 can appear and disappear with respect to the skirt 3 as shown in FIG. 4. With the pivot structure of the hidable wheels 15, the wheels 15 of the potty of the fourth embodiment may disappear in the skirt 3 of the potty body as shown at the dotted line of FIG. 4 so that this potty can be used as a typical potty while placed on a given position. The wheels 15 may appear out of the skirt 3 as shown at the solid line of FIG. 4 so that this potty can be used as a riding toy.

The potty according to a fifth embodiment is provided with varieties of interesting animal legs 16 on the lower end of the skirt 3 of the potty body as shown in FIG. 5, which potty body has the same construction as that of the first embodiment of FIG. 1. The potty of the fifth embodiment can be selectively used as a typical potty while placed in a given position or as a riding toy. In the potty of the fifth embodiment, it is preferred to provide a plurality of sets of legs 16 of different heights and different designs for the potty and to couple a set of legs 16 agreeable to an infant using the potty to the potty body. The animal legs 16 may be coupled to the potty body by means of appropriate conventional coupling means, such as fitting means, and further explanation for the leg coupling means is not deemed necessary.

In the potties according to the first to fifth embodiments of the invention, the sound generator 4 or 11 may generate a sweet sound, such as sweet melody or sweet voice message stimulating interest of infants, for a given time when the infant relieves oneself in a correct body position such that the urine reaches a predetermined position of the potty. Alternatively, the sound generator 4 or 11 may alternately generate the sweet melody and the sweet voice message stimulating interest of the infant for a given time. As a further alternative, the sound generator 4 or 11 may be programmed with a plurality of different audio signals and selectively generate one of the programmed audio signals when the infant relieves oneself in a correct pose of body such that the urine reaches a predetermined position of the potty. Furthermore, the amplifier 5 or 12 may be provided with conventional means for controlling the volume of the sound generated by the sound generator 4 or 11.

As described above, the present invention provides a potty which has a typical potty function and generates a sweet sound, such as sweet melody or sweet voice message stimulating interest of infants, when an infant relieves oneself in a correct pose of body such that the urine reaches a predetermined position, thereby letting the infants naturally early accustom themselves to relieve themselves in a given place and in the correct pose of body and promoting emotion and character building of the infants. The potty of the invention may be provided with wheels or interesting animal legs so that the potty may be selectively used as a typical potty located at a given position or as a riding toy.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A potty comprising a seat, a bowl and a skirt supporting the seat and the bowl, further comprising;

a first switch mounted in a predetermined portion of said seat, said first switch being normally turned off but turned on by the weight of an infant when the infant is seated on the seat;

a second switch mounted in a predetermined portion of a bottom of said bowl, said second switch being normally turned off but turned on when the second switch comes into contact with urine;

a first sound generator mounted in a predetermined portion of the potty and electrically connected to the first and second switches and generating a sound when said first and second switches are both in turned on conditions; and a urine receptacle detachably mounted to a predetermined portion of the potty, said urine receptacle having a third switch and a second sound generator, said second sound generator being electrically connected to said third switch and generating a sound when said third switch is turned on.

2. The potty according to claim 1, wherein said urine receptable comprises:

a front wall for receiving and guiding the urine downward without splashing of the urine; and a target provided on said front wall such that said third switch is placed in the center of the target.

3. The potty according to claim 1, further comprising a plurality of detachable wheels, said wheels being detachably mounted on a lower section of the potty.

4. The potty according to claim 1, further comprising a plurality of retractable wheels, said wheels being pivoted to a lower section of the potty for movement internally and externally of the potty.

5. The potty according to claim 1, further comprising a plurality of detachable legs.

* * * * *